US008205660B2

(12) United States Patent
Lipowski

(10) Patent No.: US 8,205,660 B2
(45) Date of Patent: Jun. 26, 2012

(54) DEVICE FOR TRANSFERRING CONTINUOUS CASTING SLABS

(75) Inventor: Michael Lipowski, Seck (DE)

(73) Assignee: SMS Siemag AG, Düsseldorf (DE)

( * ) Notice: Subject to any disclaimer, the term of this patent is extended or adjusted under 35 U.S.C. 154(b) by 186 days.

(21) Appl. No.: 12/677,037

(22) PCT Filed: Aug. 6, 2008

(86) PCT No.: PCT/DE2008/001303

§ 371 (c)(1),
(2), (4) Date: Mar. 8, 2010

(87) PCT Pub. No.: WO2009/030190

PCT Pub. Date: Mar. 12, 2009

(65) Prior Publication Data

US 2010/0200364 A1 Aug. 12, 2010

(30) Foreign Application Priority Data

Sep. 6, 2007 (DE) ..... 10 2007 043 003

(51) Int. Cl.
*B22D 11/128* (2006.01)

(52) U.S. Cl. ..... 164/269

(58) Field of Classification Search ..... 164/269, 164/441, 442, 447, 448
See application file for complete search history.

(56) References Cited

U.S. PATENT DOCUMENTS

| | | | | |
|---|---|---|---|---|
| 5,115,547 | A * | 5/1992 | Rohde | 29/33 C |
| 5,560,095 | A * | 10/1996 | Kruger | 29/527.7 |
| 2005/0039320 | A1 | 2/2005 | Thomanek | |

FOREIGN PATENT DOCUMENTS

| | | |
|---|---|---|
| DE | 10 2005 011254 | 9/2006 |
| EP | 0438066 | 7/1991 |
| EP | 0 593 001 | 4/1994 |
| WO | WO 03/039775 | 5/2003 |

* cited by examiner

*Primary Examiner* — Kevin P Kerns
(74) *Attorney, Agent, or Firm* — Cozen O'Connor

(57) ABSTRACT

A device for transferring continuous cast slabs arranged parallel to and equidistant from one another to an individual production line arranged in extension of one of the continuous casting strands, wherein the cycle time for transferring and conveying the slabs is to be reduced. This is achieved by a ferry which is movable transversely by steps between the ends of the continuous casting strands and the start of the production line and which has berths serving for receiving and delivering the slabs substantially simultaneously.

8 Claims, 3 Drawing Sheets

AVERAGE CYCLE TIME (AVERAGED OVER 3 SLABS)

$(t_{0.5move} + t_{out} + 2 \times t_{0.5move} + t_{out} + t_{0.5move} + t_{out})/3 = 4/3\ t_{0.5move} + t_{out}$

AVERAGE CYCLE TIME (AVERAGED OVER 3 SLABS)

$(2xt_{0.5move} + t_{out} + t_{0.5move} + t_{out})/3 = 4/3xt_{0.5move} + t_{out}$

AVERAGE CYCLE TIME (AVERAGED OVER 4 SLABS)

$(t_{0.5move} + t_{out} + t_{0.5move} + t_{out} + t_{0.5move} + t_{out} + t_{0.5move} + t_{out})/4 = t_{0.5move} + t_{out}$

AVERAGE CYCLE TIME (AVERAGED OVER 3 SLABS)

$(t_{0.5move} + t_{out} + 2 \times t_{0.5move} + t_{out} + t_{0.5move} + t_{out})/3 = 4/3\ t_{0.5move} + t_{out}$

DEVICE FOR TRANSFERRING CONTINUOUS CASTING SLABS

PRIORITY CLAIM

This is a U.S. national stage of application No. PCT/DE2008/001303, filed on Aug. 6, 2008, which claims Priority to the German Application No. 10 2007 043 003.7, filed: Sep. 6, 2007, the contents of both being incorporated herein by reference.

BACKGROUND OF THE INVENTION

1. Field of the Invention

The invention is directed to a device for transferring continuous cast slabs from continuous casting strands arranged parallel to and equidistant from one another to an individual production line arranged in extension of one of the continuous casting strands.

2. Related Art

Various devices of the type mentioned above are known.

For example, EP 908 244 B1 describes an installation in which cast strands exiting from two or more continuous casting machines are fed to a rolling installation, namely, by a pivotable guide section aligned with the continuous casting strands and the rolling line on the other hand.

In a plant with three continuous casting strands, this pivotable guide section, known as a swivel ferry, is associated with the middle continuous casting strand and its free end can swivel into the line of the two continuous casting strands arranged on either side of it. The rolling line is generally aligned with the middle continuous casting strand so that the severed slabs arriving on the two side continuous casting strands are received by the swivel ferry, redirected by the latter to the middle continuous casting strand, and then guided forward again into the rolling line.

Therefore, operating three continuous casting strands with one swivel ferry causes a substantial bottleneck in the overall production flow.

Owing to the extensive cycle time, substantially by reason of the time required for feeding the slabs or roughed strip from the outer strands to the finishing train, this finishing train cannot be used to its full potential.

For example, if it is necessary to change rolls in the finishing train, the feed to the continuous casting strands must serve as a buffer. With a long cycle time, it would require considerable time to reduce this buffer.

Further, the middle continuous casting strand is shorter due to the arrangement of the swivel ferry and therefore offers less space for accumulation and buffering.

Because of the two reversals of direction, when transferring to the swivel ferry and when conveying onward to the finishing train, the holding time in the furnace system and, therefore, the formation of scale is increased. Scale loss reduces yield and quality of the product is affected.

SUMMARY OF THE INVENTION

It is an object of the invention to provide a device for transferring or conveying continuous cast slabs which operates with substantially reduced cycle times so that the production flow of the continuous casting installation can be better adapted to that of the finishing train.

According to one embodiment of the invention, this object is met by a ferry which is movable transversely by steps between the ends of the continuous casting strands and the start of the production line and which has berths on which the slabs are received and from which the slabs are delivered.

This solution offers two alternative constructions, namely, on the one hand, the ferry can have two berths which are arranged at a distance from one another corresponding to the distance of the continuous casting strands from one another, wherein the ferry is then movable transversely in each instance by the distance between the continuous casting strands. On the other hand, the ferry can have three berths, the two outer berths being spaced apart by the distance of the continuous casting strands from one another, and the third berth being provided between the two outer berths. The ferry is then movable transversely by one half of the distance between the continuous casting strands.

The length of the berths on the ferry corresponds at least to the slab length.

In an advantageous construction, the berths can be constructed identical to the holding furnace.

The advantages of the solutions mentioned above consist in the reduced cycle times, which will be made clear by the following description.

DETAILED DESCRIPTION OF THE DRAWINGS

Figure 1:
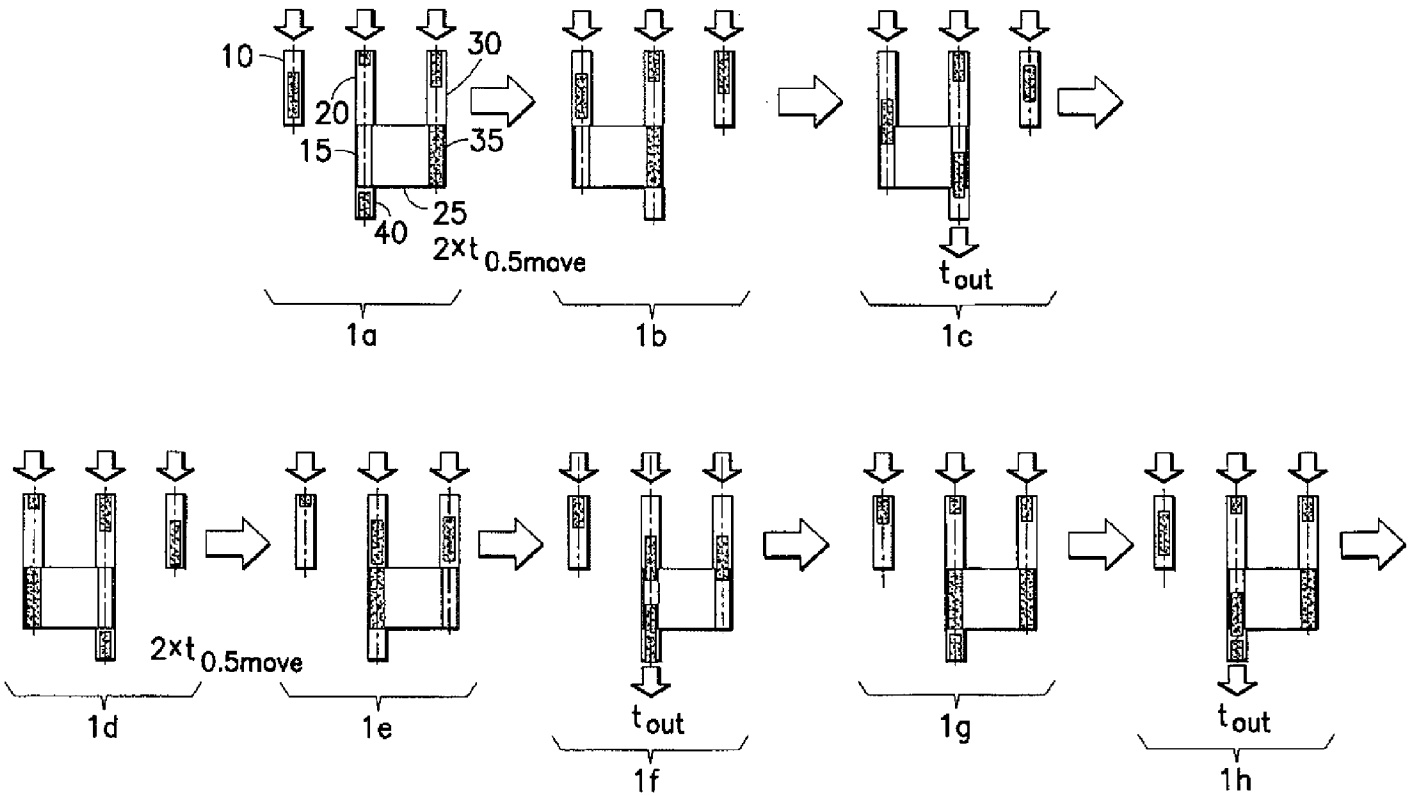
FIG. 1 is a first two berth arrangement.

Starting with the first embodiment example of FIG. 1, three continuous casting strands 10, 20, 30 are provided which are arranged equidistant from one another, i.e., side by side. The finishing train 40 is associated with the middle continuous casting strand, i.e., the middle continuous casting strand is oriented in line with the finishing train.

The ferry 25 has two berths 15, 35 whose side-to-side distance on the ferry corresponds to the distance of the continuous casting strands from one another.

The ferry 25 is movable transversely between the end of the continuous casting strands 10, 30 and the start of the finishing train, 40 namely, by steps, i.e., during the transverse movement, one berth 15, 35 on the ferry 25 is always aligned with the finishing train 40 or production line 10, 20, 30, and the second berth 15, 35 is always aligned with one of the lateral continuous casting strands 10, 20, 30. Accordingly, the stepwise movement means that the ferry 25 is movable transverse to the continuous casting strands 10, 20, 30 by the distance of the continuous casting strands from one another.

In stating that there are two berths 15, 35 on a ferry 25, this, of course, also includes the possibility that two ferries, each with one berth, are connected so that they behave as one ferry with respect to movement.

It will be described in the following how the individual movement sequences can be carried out.

In the second alternative (FIG. 2) construction mentioned above, a ferry 200 has three berths 210, 220, 230, the two outer berths 210, 230 having a distance from one another that corresponds to the distance of the continuous casting strands 10, 20, 30 from one another.

In this solution, the ferry 200 is likewise moved by steps, but in each instance by half of the distance of the continuous casting strands from one another so that one of the berths 210, 220, 230 is always aligned with a continuous casting strand 10, 20, 30 and another berth is always aligned with the finishing train 40 or production line at all times.

Naturally, in this case too, the ferry 200 can also comprise individual ferries which are connected to one another.

This solution is optimal with respect to cycle times, which will be explained below when examining the possible movements.

This solution also has the further attractive advantage that the middle continuous casting strand can be approached twice as often as the two side continuous casting strands. This raises the possibility, for example, of processing shorter slab lengths in the middle continuous casting strand or selecting a feed speed in this continuous casting strand that is faster than that in the two side continuous casting strands.

In case a buffer is formed, this buffer can also be reduced at different speeds in individual continuous casting strands with this inventive solution.

To facilitate understanding of the invention, the sequence of movements for the two construction variants will be described with reference to the drawings. The device is only shown schematically in these drawings with three continuous casting strands and one ferry.

Starting with the first alternative of FIG. 1, in which the distance between the berths 15, 35 on the ferry 25 corresponds to the distance between the continuous casting strands 10-20 and 20-30, FIG. 1*a* shows that the ferry 25 is positioned in front of the middle 20 and right-hand 30 continuous casting strands. A slab has been deposited on the finishing train 40 in the middle, while a slab has been delivered from the right-hand continuous casting strand. The ferry 25 is then moved to the left by one step (1*b*) so that, on the one hand, a slab can again be delivered in the middle and, on the other hand, a slab is received on the left-hand side.

FIG. 1*f* shows the simultaneous charging of the two berths 15, 35 from the middle continuous casting strand 20 and right-hand continuous casting strand 30, while the slab which is still located on the ferry 25 is simultaneously delivered to the finishing train 40.

The sequence of slab delivery to the finishing train 40 can, of course, also be altered when the ferry 25 moves correspondingly, namely, when a new slab is received but, by traveling over the middle continuous casting strand and finishing train, a second slab is received first and then in turn delivered beforehand.

In the embodiment according to FIGS. 1*a*-1*h*, an average cycle time (averaged over three slabs) is given by:

$$(2\times t_{0.5move}+t_{out}+2\times t_{0.5move}+t_{out}+t_{out})/3=4/3\times t_{0.5move}+t_{out}.$$

Figure 2:
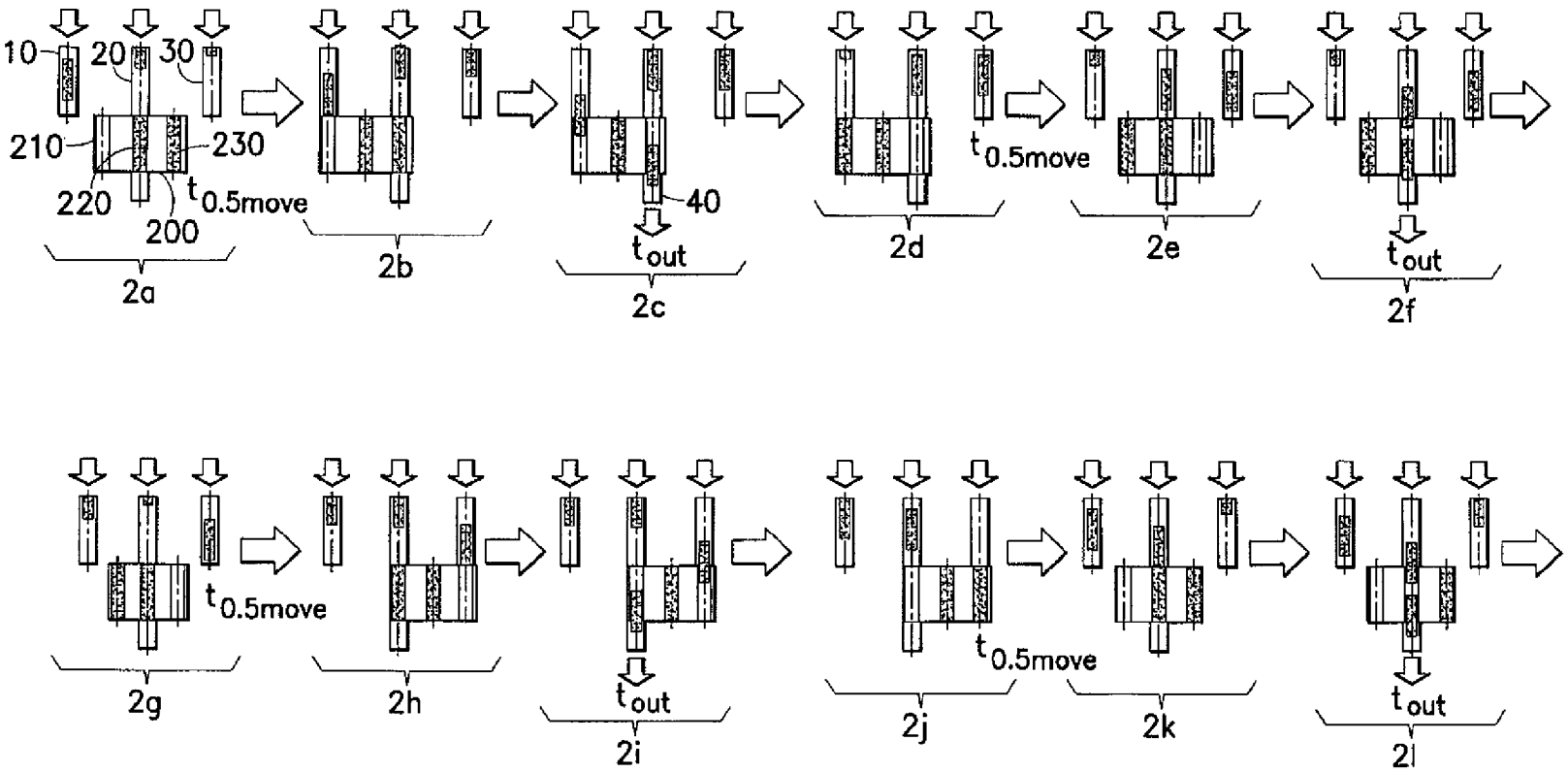
FIG. 2 is a first three berth arrangement.

The operation of a ferry 200 having three berths 210, 220, 230 is shown in the individual parts of FIG. 2. The two outer berths 210, 230 are arranged at a distance from one another corresponding to the distance of the continuous casting strands from one another i.e., 10-20 or 20-30, and the third berth 220 is arranged therebetween.

In this case, only a movement by one half of the distance between the continuous casting strands is needed for achieving a subsequent exchanging position, i.e., a receiving position or delivery position. FIG. 2*b* shows the receiving position for receiving a third slab from the continuous casting strand on the left-hand side and FIG. 2*c* shows a slab being received in the left-hand berth 210 and the simultaneous delivery to the finishing train 40 from the right-hand berth 230. Additional exchanging processes are clearly shown in the other drawings and therefore need not be discussed in detail.

The average cycle time (averaged over four slabs) is given by the following equation:

$$(t_{0.5move}+t_{out}+t_{0.5move}+t_{out}+t_{0.5move}+t_{out}+t_{0.5move}+t_{out})/4=t_{0.5move}+t_{out}.$$

Figure 3:
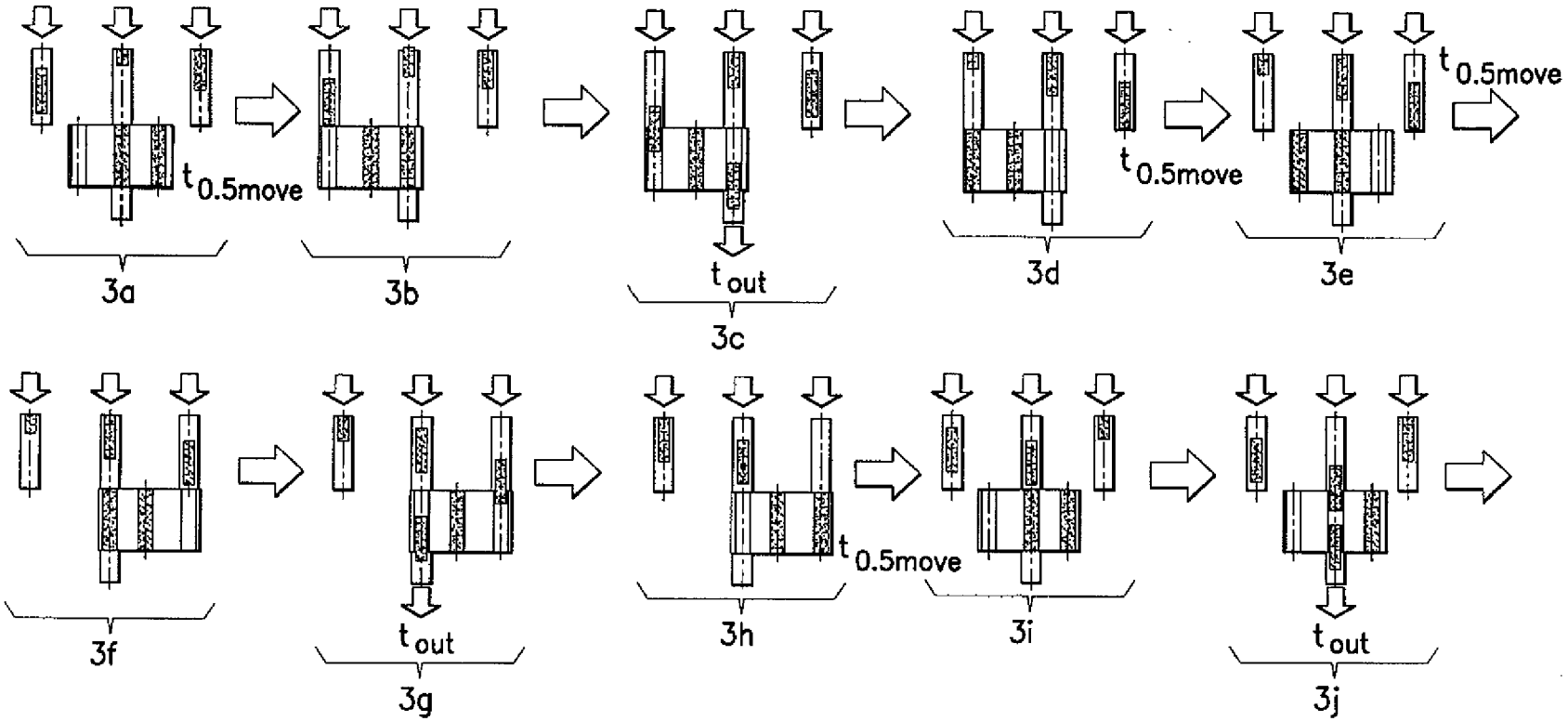
FIG. 3 is a second three berth arrangement.

Finally, reference is had to the variants shown in FIG. 3, which shows the movement sequence and the individual transfer or delivery of the slab in the FIGS. 3*a* to 3*j*.

Here, again, an average cycle time (averaged over three slabs) can be specified by:

$$(t_{0.5move}+t_{out}+2\times t_{0.5move}+t_{out}+t_{0.5move}+t_{out})/3=4/3t_{0.5move}+t_{out}.$$

Although the expression "slab" is always used in the preceding description, it should be noted that the solution according to the invention is also suitable for roughed strip or for transferring or conveying other products to be handled in comparable production processes.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A ferry for transferring continuous cast slabs from continuous casting strands arranged parallel to and equidistant from one another to an individual production line arranged in extension of one of the continuous casting strands, the ferry configured to move transversely by steps between ends of the continuous casting strands, comprising:

a first end of the ferry configured to mate with the ends of the continuous casting strands;

a second end of the ferry opposite the first end configured to mate with a start of the production line;

three berths arranged adjacent to one another, the two outer berths spaced apart by a distance of the continuous casting strands from one another, and the third berth is provided therebetween, wherein the ferry is movable transversely by one half of the distance between the continuous casting strands.

2. The device according to claim 1, wherein a length of each berth on the ferry corresponds at least to a slab length.

3. The device according to claim 1, wherein at least one berth is configured as a holding furnace.

4. The device according to claim 2, wherein at least one berth is configured as a holding furnace.

5. The device according to claim 1, wherein each berth is configured as a holding furnace.

6. The device according to claim 2, wherein each berth is configured as a holding furnace.

7. The device according to claim 1, an average cycle time averaged over four slabs is given by:

$$(t_{0.5move}+t_{out}+t_{0.5move}+t_{out}+t_{0.5move}+t_{out}+t_{0.5move}+t_{out})/4=t_{0.5move}+t_{out}.$$

8. The device according to claim 1, an average cycle time averaged over three slabs is given by:

$$(t_{0.5move}+t_{out}+2\times t_{0.5move}+t_{out}+t_{0.5move}+t_{out})/3=4/3t_{0.5move}+t_{out}.$$

* * * * *